US011008779B1

(12) United States Patent
Chen

(10) Patent No.: US 11,008,779 B1
(45) Date of Patent: May 18, 2021

(54) ELECTRONIC LOCK CORE DEVICE

(71) Applicant: Te-Yu Chen, Pingtung (TW)

(72) Inventor: Te-Yu Chen, Pingtung (TW)

( * ) Notice: Subject to any disclaimer, the term of this patent is extended or adjusted under 35 U.S.C. 154(b) by 0 days.

(21) Appl. No.: 16/849,960

(22) Filed: Apr. 15, 2020

(51) Int. Cl.
*E05B 47/06* (2006.01)
*G07C 9/00* (2020.01)

(52) U.S. Cl.
CPC ..... *E05B 47/0673* (2013.01); *G07C 9/00309* (2013.01); *G07C 2009/00777* (2013.01)

(58) Field of Classification Search
CPC ..... E05B 47/0673; G07C 9/00309; G07C 2009/00777
See application file for complete search history.

(56) References Cited

U.S. PATENT DOCUMENTS

2016/0093130 A1* 3/2016 Shen ..... H04W 4/80 340/5.61
2019/0047646 A1* 2/2019 Mohamed ..... G07C 9/00896

* cited by examiner

*Primary Examiner* — Nader Bolourchi
(74) *Attorney, Agent, or Firm* — Leong C. Lei

(57) ABSTRACT

An electronic lock core device includes: a housing, a front end thereof configured with an opening; a transmission mechanism, configured inside the housing and with a motor in connection with a gear train, the gear train in engagement with a transmission shaft, and a front end of the transmission shaft configured with a rod; a locking piece, configured with a pendulum and fixing hole, a fixing member passed through the fixing hole and the opening on the front end of the housing and fixed to the rod; and a control circuit, configured inside the housing and in connection with the motor of the transmission mechanism and an induction device adapted to sensing a signal of a chip card or RFID to drive the transmission mechanism to drive the motor to rotate positively or negatively and further to make the locking piece form a lock or unlock action.

4 Claims, 5 Drawing Sheets

ELECTRONIC LOCK CORE DEVICE

(a) TECHNICAL FIELD OF THE INVENTION

The present invention relates to an electronic lock core device, and more particularly to an electronic lock core device, allowing for the sensing of signals of chip cards, PFID or etc. to form a lock or unlock action.

(b) DESCRIPTION OF THE PRIOR ART

Since ancient times, the role of the door lock has been to maintain the safety of the lives and property of the home. Therefore, the lock designs are naturally developed in a way of easy operation and difficulty to be opened by thieves. However, most locks are locked or unlocked with keys of mechanical types for a long time whether they are indoor ones or outdoor gate ones; using keys to lock and unlock door locks is rather inconvenient because it is easy to forget to carry them and could be better or worse in terms of safety. In addition, the same family usually needs to prepare more keys, causing inconvenience and troubles in use.

Although many electronic locks are currently successfully developed and sold and have a tendency to replace traditional locks gradually, but they usually are complete locks made by combining electronic components with simple mechanical ones, namely, those electronic locks have only a single finished product for purchase and application. In addition, the most important lock cores in locks have no similar electronic lock core products. It is undeniable that mechanical locks are safer than electronic locks, but the mechanical locks currently need to cooperate with the trend of the electronic life such that traditional high-safety mechanical locks cannot be changed to electronic locks through easy modification

SUMMARY OF THE INVENTION

To improve electronic locks, the present invention is proposed.

The main object of the present invention is to provide an electronic lock core device, allowed to be assembled in traditional mechanical locks, and capable of sensing signals of chip cards, RFID, or etc. to form a lock or unlock action.

To achieve the above object, the present invention proposes an electronic lock core device, including: a housing, a front end thereof configured with an opening; a transmission mechanism, configured inside the housing and configured with a motor in connection with a gear train composed of a plurality of gears, the gear train in engagement with a transmission shaft, and a front end of the transmission shaft configured with a rod; a locking piece, configured with a pendulum and fixing hole, a fixing member passed through the fixing hole and the opening on the front end of the housing and fixed to the rod; and a control circuit, configured inside the housing and in connection with the motor of the transmission mechanism and an induction device adapted to sensing a signal of a chip card or RFID to drive the transmission mechanism to drive the motor to rotate positively or negatively and further to make the locking piece form a lock or unlock action.

According to the above electronic lock core device, the transmission mechanism is covered in an inner shell, a front end of the inner shell is configured with symmetrically arranged sensing elements, the transmission shaft is extended out of a front end of the inner shell, thereby sensing the rod through the sensing element, the sensing element transmits a sensed signal to the control circuit, the control circuit is used to control the stop action of the motor according to the signal of the sensing element, and further to control the positioning of the locking piece to form a lock or unlock action.

According to the above electronic lock core device, the rod configured on the transmission shaft is made of metal, and the sensing elements respectively are a metal-sensible metal sensing element.

DETAILED DESCRIPTION OF THE PREFERRED EMBODIMENTS

Figure 1:
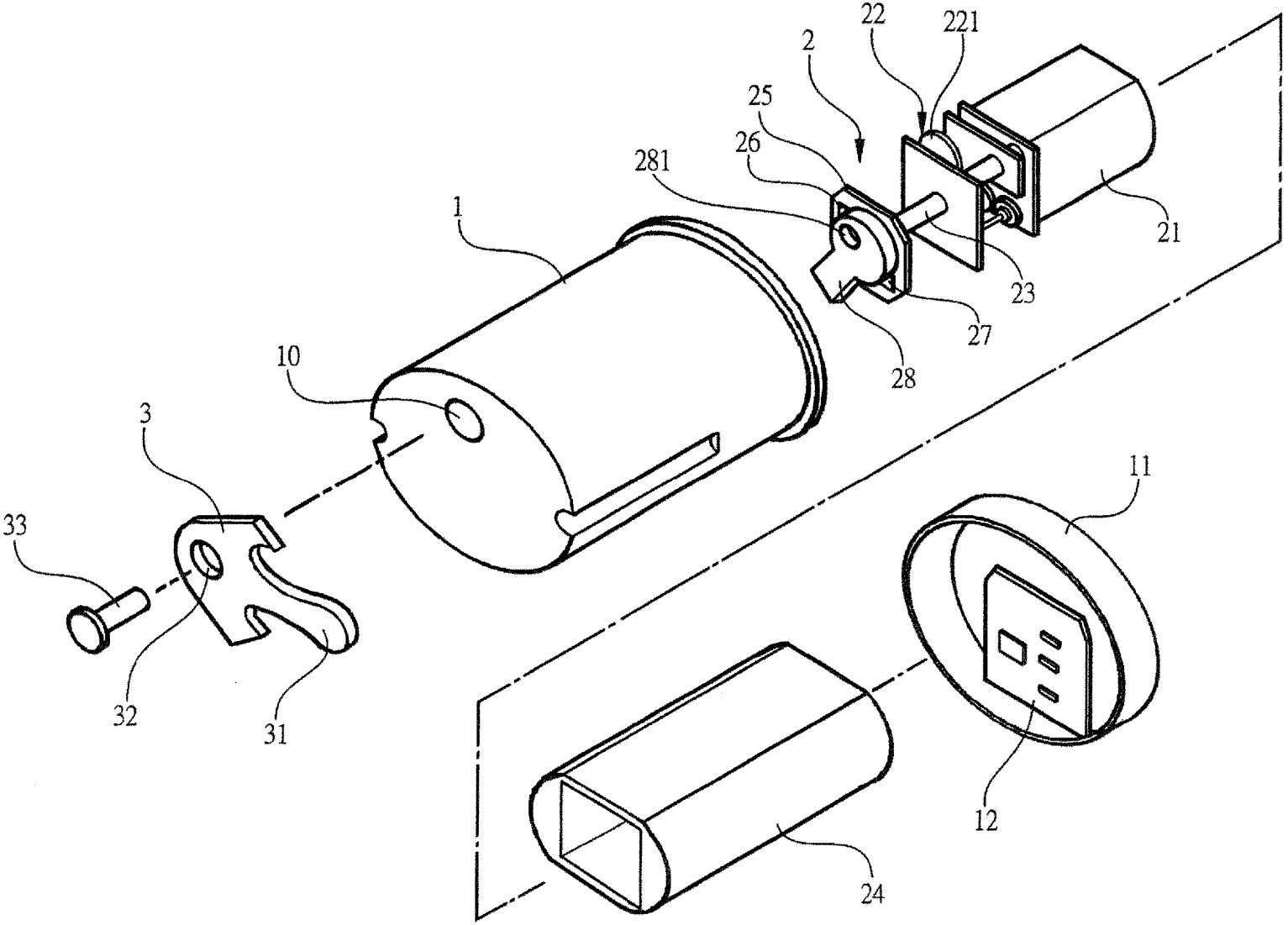
FIGS. 1 and 2 respectively are an exploded view of the present invention.
Figure 2:
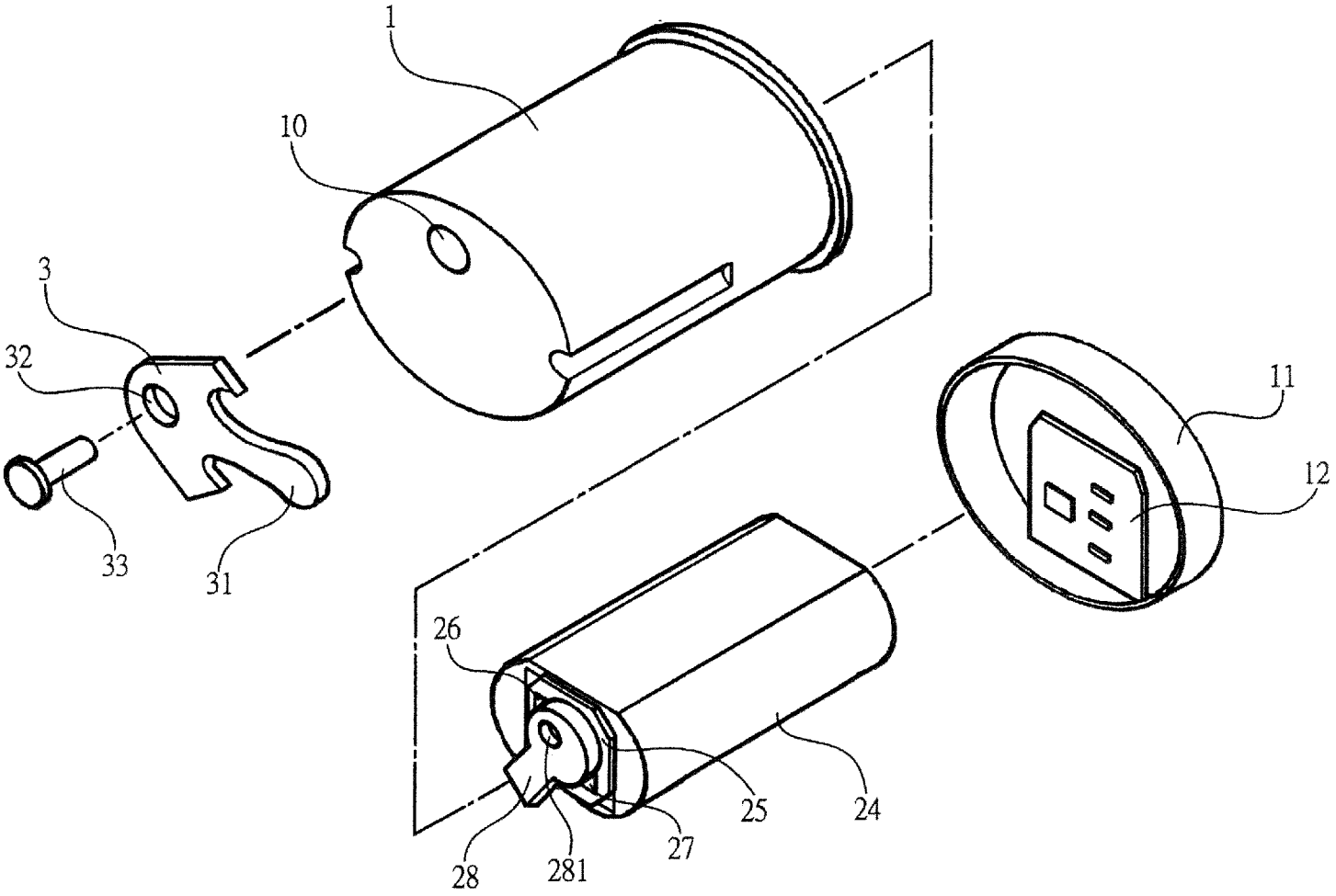
Figure 3:
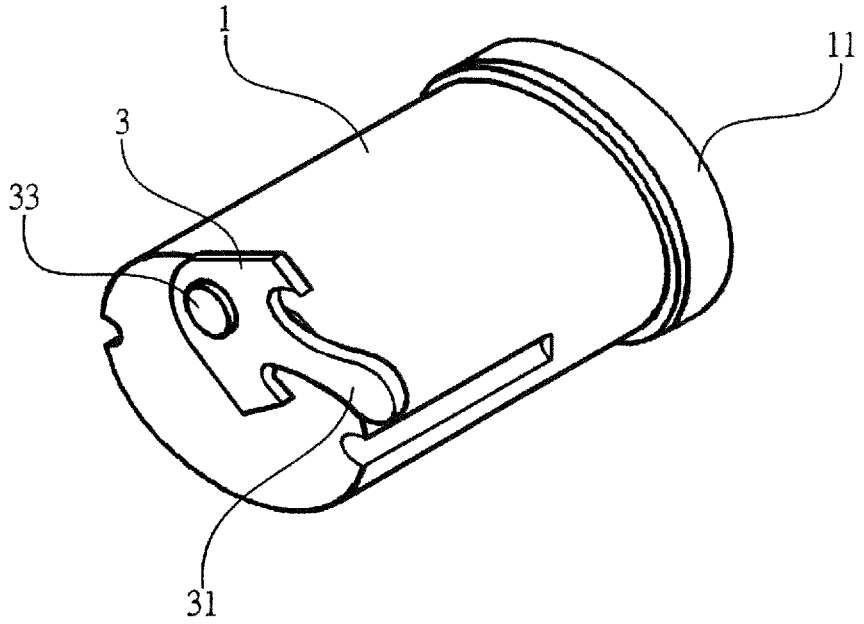
FIG. 3 is a perspective view of the present invention.

Referring to FIGS. 1, 2 and 3, an electronic lock core device of the present invention includes a housing 1, a transmission mechanism 2 configured in the housing 1 and a locking piece 3, where the front end of the housing 1 is configured with an opening 10, the rear thereof a cover 11, and the inner edge of the cover 11 a control circuit 12.

The transmission mechanism 2 is configured with a motor 21 in connection with the control circuit 12, and the motor 21 is used to be in connection with a gear train 22 composed of a plurality of gears 221. Furthermore, the gear train 22 is in engagement with a transmission shaft 23; the transmission mechanism 2 is covered by an inner shell 24, the front end of which is configured with a circuit board 25 on which symmetrically arranged sensing elements 26, 27 are configured, where the transmission shaft 23 is extended out of the front end of the inner shell 24 after passed through the circuit board 25, and the front end of the transmission shaft 23 is configured with a rod 28 on which a fixing hole 281 is opened, where the sensing elements 26, 27 respectively are a metal-sensible metal sensing element, and the rod 28 is made of metal.

The locking piece 3 is configured with a pendulum 31 and fixing hole 32, and a fixing member 33 is passed through the fixing hole 32 and opening 10 of the housing 1 and fixed to the fixing hole 281 of the rod 28. Whereby, when the motor 21 drives the transmission shaft 23 to rotate positively or negatively to drive the rod 28 to rotate positively or negatively and then drives the locking piece 3 to rotate positively or negatively, thereby sensing the rod 28 through the sensing element 26 or 27 and transmitting a signal sensed by the sensing element 26 or 27 to the control circuit 12. Thereafter, the control circuit 12 will control the stop action of the motor 21 according to the signal of the sensing element 26 or 27 and further control the positioning of the locking piece 3 so as to form a lock or unlock action.

With the combination of the above components, an electronic lock core device is constituted. The lock core device can be installed in a mechanical lock, and the control circuit 12 of the electronic lock core device can then be in connection with a sensing device, through which the signals of chip cards or RFID can be sensed; the control circuit 12 drives the transmission mechanism 2 to drive the motor 21 to rotate positively or negatively, and further to cause the locking piece 3 to form a lock or unlock action. Whereby, the electronic lock core device can be used with traditional mechanical locks to make them become electronic induction locks.

Figure 4:
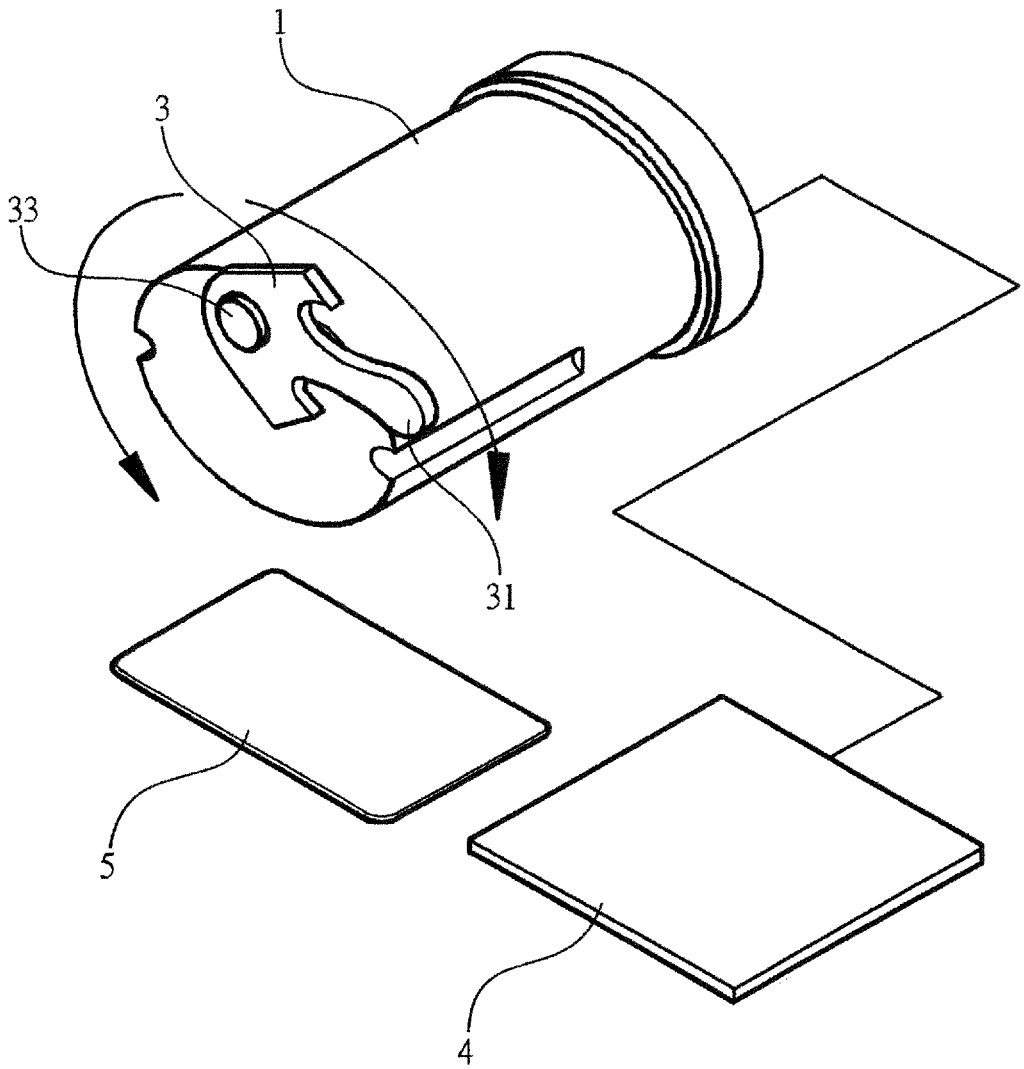
FIG. 4 is a perspective view of the present invention in a use state.
Figure 5:
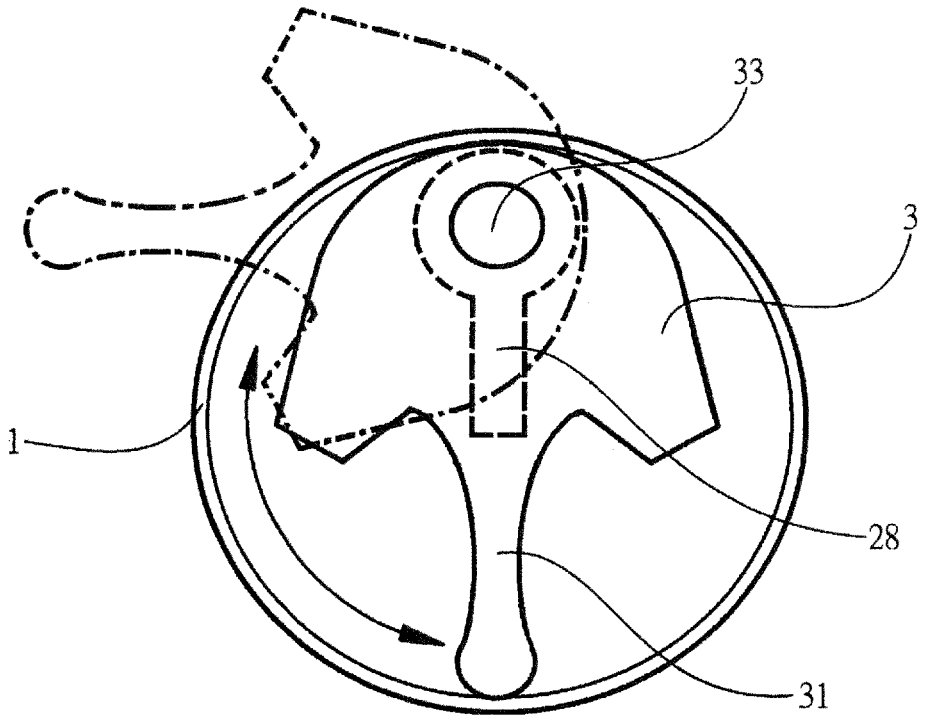
FIG. 5 is a schematic view of the present invention in an action state.

Referring to FIG. 4 and FIGS. 1 and 2 again, the electronic lock core device is installed on a mechanical lock core when the present invention is in use, and the control circuit 12 of the electronic lock core device is in connection with an induction device 4, when the present invention is put into practice, a sensing chip card 5 (or RFID) is close to the induction device 4, and the control circuit 12 drives the transmission mechanism 2 to drive the motor 21 to rotate positively or negatively after the signal of the sensing chip card 5 (or RFID) is sensed by the induction device 4, and further to make the locking piece 3 to form a lock or unlock action.

Referring to FIGS. 1, 2, 4 and 5, the induction device 4 will transmit the signal received by it to the control circuit 12 when the sensing chip card 5 (or RFID) is close to the induction device 4, and further to drive the locking piece 3 to form an unlock action. When the transmission shaft 23 is rotated positively, the rod 28 is driven to move at the same time. Furthermore, the signal is transmitted to the control circuit 12 to cause the motor 21 to be stopped after the control circuit 12 (to maintain in a unlock state) after the interpretation of the control circuit 12 when the sensing element 26 senses the rod 28.

Furthermore, the control circuit will drive the motor 21 to rotate negatively after the present invention in the unlock state for a while and further drive the locking piece 3 to form a lock action. When the transmission shaft 23 is rotated negatively, the rod is driven to move at the same time, and the signal is transmitted by the sensing element 27 to the control circuit 12 when the sensing element 27 senses the rod 28, and the motor 21 is caused to stop (to maintain in the lock state) after the interpretation of the circuit 12, thereby completing a cycle of unlock action.

The foregoing embodiments are merely illustrative of the preferred embodiments of the present invention, and are not intended to limit the scope of the present invention, and the modifications and changes thereof are still without departing from the spirit of the present invention.

To sum up, the present invention uses the transmission mechanism of he gear train and the motor to cooperate with the sensing component provided at the front end of the transmission mechanism to form the electronic lock core device so as to allow it to be assembled on traditional mechanical locks, enabling the signal of the chip card or RFID to be sensed so as to form a lock or unlock action.

I claim:

1. An electronic lock core device, comprising:

a housing, a front end thereof configured with an opening;

a transmission mechanism, configured inside said housing and configured with a motor in connection with a gear train composed of a plurality of gears, said gear train in engagement with a transmission shaft, and a front end of said transmission shaft configured with a rod;

a locking piece, configured with a pendulum and fixing hole, a fixing member passed through said fixing hole and said opening on said front end of said housing and fixed to said rod; and a control circuit, configured inside said housing and in connection with said motor of said transmission mechanism and an induction device adapted to sensing a signal of a chip card or RFID to drive said transmission mechanism to drive said motor to rotate positively or negatively and further to make said locking piece form a lock or unlock action;

wherein said transmission mechanism is covered in an inner shell, a front end of said inner shell is configured with symmetrically arranged sensing elements, said transmission shaft is extended out of a front end of said inner shell, thereby sensing said rod through each sensing element of said symmetrically arranged sensing elements, said sensing element transmits a sensed signal to said control circuit, said control circuit is used to control the stop action of said motor according to said signal of said sensing element, and further to control the positioning of said locking piece to form a lock or unlock action.

2. The device according to claim 1, wherein said sensing elements are configured on said circuit board, and said transmission shaft is passed through said circuit board and then extended out of a front end of said inner shell.

3. The device according to claim 1, wherein said sensing elements configured on said circuit board on said front end of said inner shell respectively are metal-sensible metal sensing elements, and said rod is made of metal.

4. The device according to claim 1, wherein a rear of said housing is configured with a cover, and said control circuit is configured on an inner edge of said cover.

* * * * *